US010112817B2

(12) United States Patent
Kim

(10) Patent No.: US 10,112,817 B2
(45) Date of Patent: Oct. 30, 2018

(54) DISPENSER ASSEMBLY FOR REFRIGERATOR

(71) Applicant: Dongbu Daewoo Electronics Corporation, Seoul (KR)

(72) Inventor: Dong Sun Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/471,819

(22) Filed: Mar. 28, 2017

(65) Prior Publication Data

US 2017/0305730 A1 Oct. 26, 2017

(30) Foreign Application Priority Data

Apr. 26, 2016 (KR) ..... 10-2016-0050805

(51) Int. Cl.

| | |
|---|---|
| ***B67D 1/00*** | (2006.01) |
| ***B05B 12/00*** | (2018.01) |
| ***F25D 23/12*** | (2006.01) |
| *F25D 23/02* | (2006.01) |

(52) U.S. Cl.

CPC ..... *B67D 1/0009* (2013.01); *B05B 12/002* (2013.01); *F25D 23/126* (2013.01); *B67D 2001/0087* (2013.01); *B67D 2210/00036* (2013.01); *F25D 23/028* (2013.01); *F25D 2500/02* (2013.01)

(58) Field of Classification Search

CPC ..... F25D 23/126; B67D 2210/00036; B05B 12/002

See application file for complete search history.

(56) References Cited

U.S. PATENT DOCUMENTS

| | | | | | |
|---|---|---|---|---|---|
| 2,512,395 | A * | 6/1950 | Sundberg | F25D 23/126 | 222/182 |
| 3,476,295 | A * | 11/1969 | Telfer | F25D 23/04 | 222/183 |
| 5,366,117 | A * | 11/1994 | Mesenbring | B67D 1/0004 | 222/132 |
| 5,881,930 | A * | 3/1999 | Lee | B67D 3/0025 | 222/509 |
| 7,007,500 | B2 * | 3/2006 | Lee | F25C 5/005 | 222/146.6 |
| 2008/0184730 | A1 * | 8/2008 | Voglewede | F25D 23/126 | 62/389 |
| 2010/0307184 | A1 * | 12/2010 | Jung | F25D 23/126 | 62/389 |
| 2016/0370100 | A1 * | 12/2016 | Kim | F25C 5/005 | |
| 2017/0307284 | A1 * | 10/2017 | Kim | B67D 1/0009 | |

FOREIGN PATENT DOCUMENTS

| | | | |
|---|---|---|---|
| KR | 20-0307819 | Y1 | 3/2003 |
| KR | 20-2009-0002606 | U | 3/2009 |
| KR | 10-2009-0043992 | A | 5/2009 |

* cited by examiner

*Primary Examiner* — J. Casimer Jacyna

(57) ABSTRACT

A dispenser assembly for a refrigerator includes a dispenser body, a water supply flow path and a removable discharge nozzle removably placed in a storage part formed in the dispenser body. The removable discharging unit is coupled to an extension hose and can be pulled out of the dispenser body by a user for dispensing water.

8 Claims, 6 Drawing Sheets

DISPENSER ASSEMBLY FOR REFRIGERATOR

CROSS-REFERENCE TO RELATED APPLICATION

This application is based on and claims priority from Korean Patent Application No. 10-2016-0050805, filed on Apr. 26, 2016, the disclosure of which is incorporated herein in its entirety by reference for all purposes.

TECHNICAL FIELD

Embodiments of the present disclosure relate to refrigerators, and more particularly, to water dispensers in refrigerators.

BACKGROUND

A refrigerator is an appliance used for storing food or other times at low temperature, e.g., in a frozen state or refrigerated state. Typically the storage space in the refrigerator is divided into a refrigeration compartment and a freezer compartment.

Some refrigerators are equipped with a water purifier and an ice maker. Typically, the ice maker may be installed in any one of a freezer compartment, a refrigeration compartment and a door.

In some refrigerators, a dispenser can dispense both water and ice. The dispenser can be installed on the outer side of a refrigerator door.

As illustrated in FIG. 1, conventionally, a dispenser body 12 is disposed in a recess on a door. An ice discharge port 14, an ice guide 16, a water discharge port 18, a water discharge lever 11, an ice discharge lever 13 and the like may be located in the recess (see, e.g., U.S. Pat. No. 7,874,460).

For example, the ice discharge port 14 is formed at one side of the dispenser body 12 (e.g., at the inner side of the recess). The ice guide 16 is coupled to the end of the ice discharge port 14. The water discharge port 18 is formed at another side of the dispenser body 12 (e.g., at the outer side of the recess). The ice discharge port 14 and the water discharge port 18 are fixedly disposed on the recess side of the dispenser.

The water discharge lever 11 for discharging water from the water discharge port 18 is mounted at the outer side of the ice guide 16. The ice discharge port 14, the ice guide 16 and the ice discharge lever 13 for discharging ice pieces are disposed at a side of an inner wall surface of the recess.

However, as the water discharge port is fixed on the dispenser, a user may find it difficult to fit a container into the recess to receive water or ice if the container does not fit in the recess.

SUMMARY

Embodiments of the present disclosure provide a dispenser assembly for a refrigerator that includes a removable discharging nozzle for dispensing water.

In accordance with one embodiment, the dispenser assembly includes a dispenser body; a water supply flow path disposed in the dispenser body; a removable discharge nozzle removably stored in a storage part formed in the dispenser body and configured to selectively discharge water supplied from the water supply flow path; and an extension hose configured to interconnect the water supply flow path and the removable discharge nozzle so that the removable discharge nozzle can be drawn out from the storage part. The removable discharge nozzle includes a discharge body having a discharge flow path through which the water flows; a rotary shaft installed in the discharge flow path; an opening/closing member mounted to the rotary shaft to selectively open the discharge flow path; and a discharge button configured to rotate the opening/closing member to open the discharge flow path.

The removable discharge nozzle may further include an elastic member configured to keep the opening/closing member in a closed state with respect to the discharge flow path; an opening/closing bar protruding from the opening/closing member so that the discharge flow path is opened when the opening/closing bar is pushed by the discharge button; and a sealing member disposed on an outer circumferential surface of the opening/closing member.

The dispenser assembly may further include a water discharge lever configured to selectively open and close the water supply flow path.

The storage part may have an engagement portion which pushes the discharge button to open the discharge flow path when the removable discharge nozzle is present in the storage part.

The dispenser assembly may further include a sensing unit configured to sense whether the removable discharge nozzle is removed from the storage part.

The dispenser assembly may further include a control unit configured to apply an operation signal for opening the water supply flow path, to a water discharge lever when the sensing unit senses that the removable discharge nozzle is removed from the storage part.

In accordance with another aspect, there is disposed a dispenser assembly for a refrigerator, including: a dispenser body; a water supply flow path disposed in the dispenser body; a removable discharge nozzle removably supported by a storage part formed in the dispenser body and configured to selectively discharge water supplied from the water supply flow path; and an extension hose configured to interconnect the water supply flow path and the removable discharge nozzle so that the removable discharge nozzle can be drawn out from the storage part, wherein the removable discharge nozzle includes: a discharge body having a discharge flow path through which the water flows; an opening/closing member configured to selectively open the discharge flow path; an elastic member configured to keep the opening/closing member in a closed state with respect to the discharge flow path; and a discharge button configured to push the opening/closing member to open the discharge flow path.

The dispenser assembly may further include a water discharge lever configured to selectively open and close the water supply flow path.

The storage part may have an engagement portion which pushes the discharge button to open the discharge flow path when the removable discharge nozzle is stored or properly placed in the storage part.

Embodiments of the present disclosure provide a dispenser assembly for a refrigerator capable of enabling a user to freely receive water from a dispenser regardless of the size and shape of a container.

The embodiments of the present disclosure have an advantage in that it is possible to freely supply water from a dispenser through a removable discharge nozzle removably mounted to the dispenser, without restrictions in the vertical and transverse size of the recess of the dispenser.

Furthermore, the embodiments of the present disclosure have an advantage in that it is possible to supply water through a single removable discharge nozzle to a container positioned within the recess of the dispenser or a user (container) positioned distant from the dispenser body.

In addition, the embodiments of the present disclosure have an advantage in that it is possible to easily supply water from the dispenser to a user through the use of a mechanical switching function of the removable discharge nozzle.

DETAILED DESCRIPTION

Figure 1:
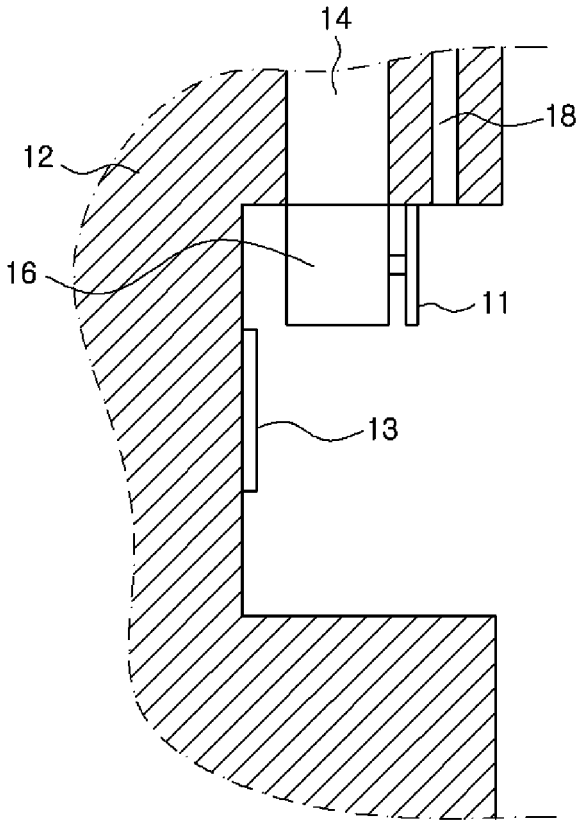
FIG. 1 (RELATED ART)
FIG. 1 is a side sectional view of a dispenser in a refrigerator of the related art.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form due to manufacturing.

Figure 2:
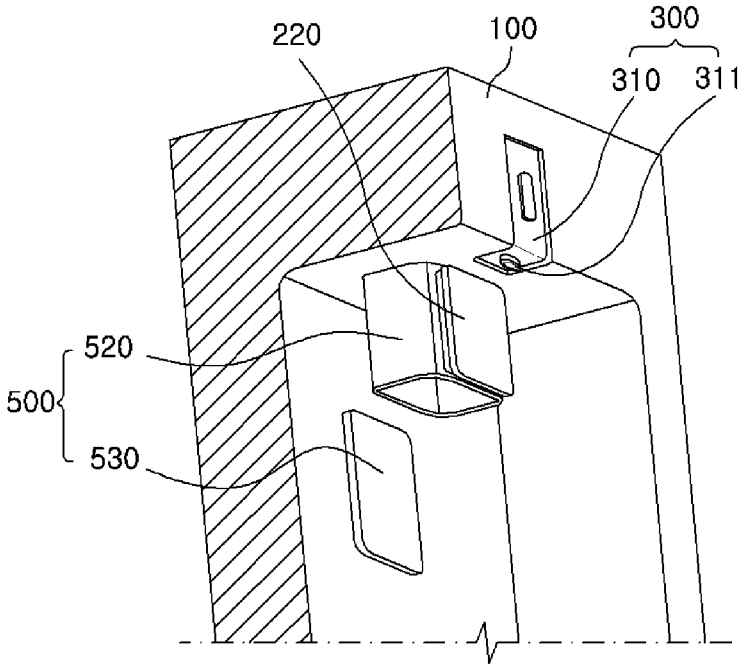
FIG. 2 is a perspective view illustrating a state in which a removable discharge nozzle is coupled to a dispenser body in an exemplary dispenser assembly of a refrigerator according to one embodiment of the present disclosure.
Figure 3:
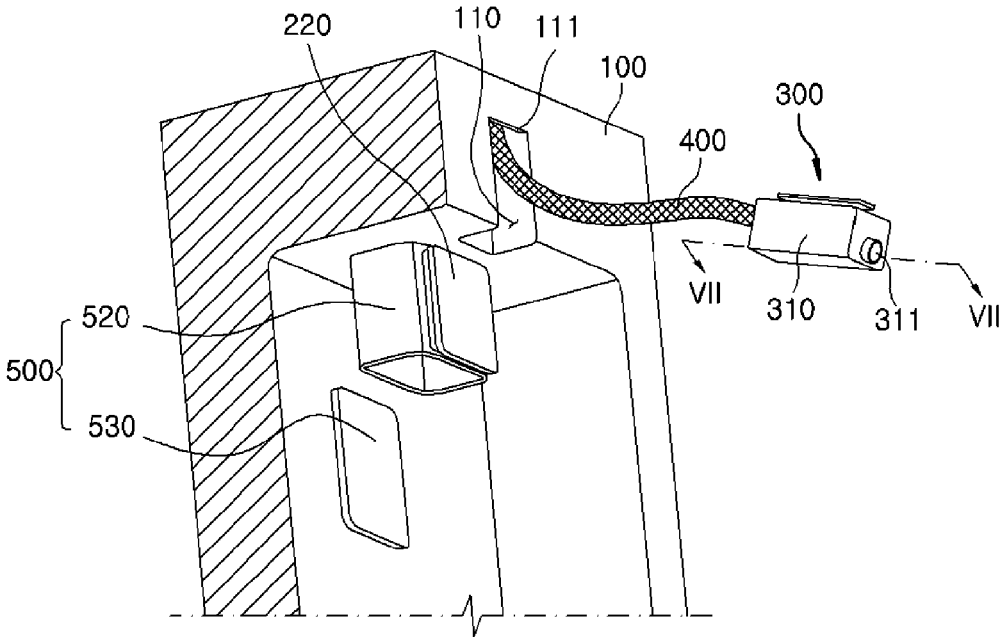
FIG. 3 is a perspective view illustrating a state in which the exemplary removable discharge nozzle is removed from the dispenser body in the dispenser assembly according to one embodiment of the present disclosure.
Figure 4:
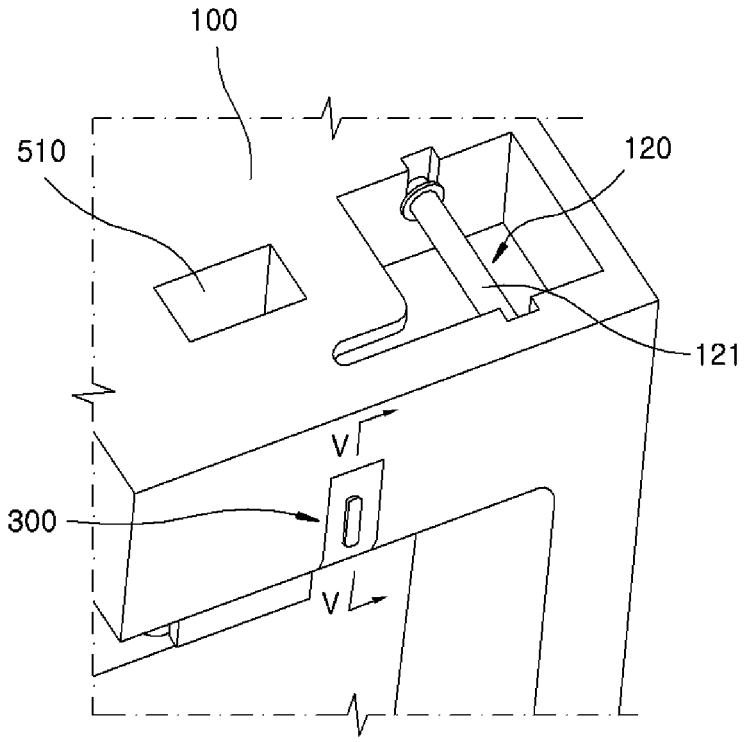
FIG. 4 is a partial perspective view illustrating an exemplary rolling accommodation part configured to accommodate an extension hose according to one embodiment of the present disclosure.
Figure 5:
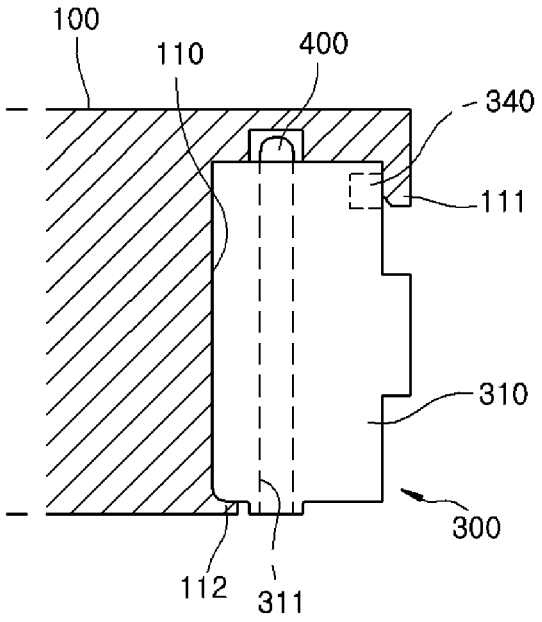
FIG. 5 is a partially cutaway sectional view taken along line V-V in FIG. 4.
Figure 6:
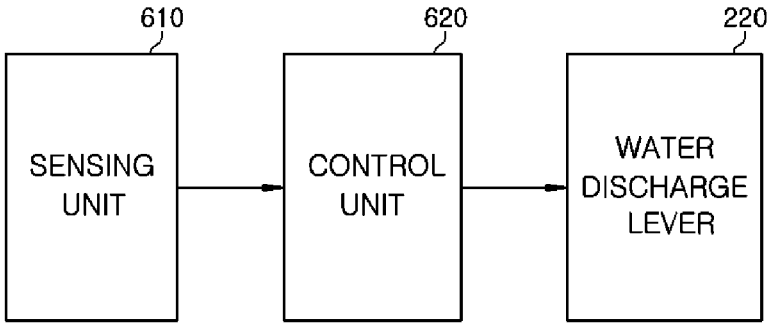
FIG. 6 is a block diagram illustrating an exemplary control flow of a sensing unit, a control unit and a water discharge lever in the dispenser assembly according to one embodiment of the present disclosure.

FIG. 2 is a perspective view illustrating a state in which a removable discharge nozzle is coupled to a dispenser body in an exemplary dispenser assembly of a refrigerator according to one embodiment of the present disclosure. FIG. 3 is a perspective view illustrating a state in which the exemplary removable discharge nozzle is removed from the dispenser body in the dispenser assembly according to one embodiment of the present disclosure. FIG. 4 is a partial perspective view illustrating an exemplary rolling accommodation part configured to accommodate an extension hose according to one embodiment of the present disclosure. FIG. 5 is a partially cutaway sectional view taken along line V-V in FIG. 4. FIG. 6 is a block diagram illustrating an exemplary control flow of a sensing unit, a control unit and a water discharge lever in the dispenser assembly according to one embodiment of the present disclosure.

As illustrated in FIGS. 2 to 6, the dispenser assembly for a refrigerator according to one embodiment of the present disclosure may include a dispenser body 100, a water supply flow path, a removable discharge nozzle 300, an extension hose 400, a water discharge lever 220, an ice supply flow path and an ice discharge unit 500.

More specifically, the dispenser body 100 may be disposed at the outer side of a front surface portion of a door of a refrigerator. Within the dispenser body 100, a water supply flow path may be used for guiding water supplied from a water purifier toward the removable discharge nozzle 300, and an ice supply flow path may be used for guiding the ice pieces supplied from an ice maker toward the ice discharge unit 500.

In the dispenser body 100, a groove-shaped recess depresses inward on a door to accommodate a container. The recess defines a space for supplying the water or the ice pieces supplied from the water purifier or the ice maker of the refrigerator to a user. The recess may be positioned in a lower portion of a front surface of the dispenser body 100. The removable discharge nozzle 300, the water discharge lever 220 and the ice discharge unit 500 may be disposed in the recess and they may be partially exposed.

A storage part 110 is disposed in the dispenser body 100 to hold the removable discharge nozzle 300. The storage part 110 may be positioned in an upper portion of a front surface of the dispenser body 100 and at the upper side of the recess. The storage part 110 is connected to a rolling accommodation part 120. Thus, the removable discharge nozzle 300 may be coupled to a roller 121 of the rolling accommodation part 120 via the extension hose 400.

An engagement portion 111 may be disposed in the storage part 110 and operate to push a discharge button 340 when the removable discharge nozzle 300 is stored (or properly placed) in the storage part 110. The engagement portion 111 may push the discharge button 340 of the removable discharge nozzle 300 stored in the storage part 110, thereby opening the discharge flow path 311 of the removable discharge nozzle 300.

The water supply flow path is opened only when the water discharge lever 220 is turned on (pushed). Thus, water supplied from the water supply flow path may be discharged through the discharge flow path 311 of the removable discharge nozzle 300 when the water discharge lever 220 is turned on (pushed).

A support portion 112 may be disposed in the storage part 110, for supporting one side of an end portion of the removable discharge nozzle 300 when the removable discharge nozzle 300 is stored in the storage part 110. The support portion 112 is configured to support one side of an end portion of the removable discharge nozzle 300 when the removable discharge nozzle 300 is stored in the storage part 110. Thus, the removable discharge nozzle 300 may be easily fitted and mounted to the storage part 110 using the engagement portion 111 and the support portion 112. A user can remove the removable discharge nozzle 300 from the storage part 110 while disengaging it from the engagement portion 111 and the support portion 112.

The rolling accommodation part 120 is an accommodation space for winding and storing the extension hose 400 when the removable discharge nozzle 300 is placed back into the storage part 110. The roller 121 for elastically winding the extension hose 400 may be mounted at the center of the rolling accommodation part 120.

Thus, when the removable discharge nozzle 300 is separated away from the storage part 110, the extension hose 400 wound around the roller 121 is unwound from the roller 121. When the separated removable discharge nozzle 300 is inserted back to the storage part 110, the extension hose 400 may be wound around the roller 121.

The water supply flow path (not shown) is a flow path for delivering water from the water purifier of the refrigerator to the removable discharge nozzle 300. The water supply flow path may communicate with the discharge flow path 311 of the removable discharge nozzle 300 via the extension hose 400. Thus, the water supplied from the water purifier may be supplied to the discharge flow path 311 of the removable discharge nozzle 300 through the water supply flow path and the extension hose 400.

The water discharge lever 220 is an opening/closing valve for opening the water supply flow path when the water discharge lever 220 is turned on (pushed) by a user. The water discharge lever 220 may be a mechanical opening/closing valve that can mechanically open and close the water supply flow path when the removable discharge nozzle 300 is stored in the storage part 110. When the path is opened, water can be discharged to the outside through the discharge flow path 311 of the removable discharge nozzle 300.

In addition, the water discharge lever 220 may be an electromagnetic opening/closing valve for maintaining an open state of the water supply flow path in conjunction with a sensing unit 610 and a control unit 620 when the removable discharge nozzle 300 is removed from the storage part 110.

Thus, if the removal of the removable discharge nozzle 300 from the storage part 110 is detected by the sensing unit 610, the water discharge lever 220 may receive an electrical signal from the control unit 620 and accordingly keep the water supply flow path in an open state. In this situation, a user may dispense water using only the discharge button 340 of the removable discharge nozzle 300.

The sensing unit 610 may include a sensor for sensing whether the removable discharge nozzle 300 is removed from the storage part 110. The sensing unit 610 may sense whether the removable discharge nozzle 300 is removed from the storage part 110 and may send a corresponding sensing signal to the control unit 620 if the removable discharge nozzle 300 is removed from the storage part 110 or if the removable discharge nozzle 300 is not properly inserted into the storage part 110.

Upon receiving the sensing signal from the sensing unit 610, the control unit 620 may determine that the removable discharge nozzle 300 is removed from the storage part 110 and may apply a turning-on (pushing) operation signal to control the water discharge lever 220 so that the water supply flow path is kept in an open state.

Thus, if the removable discharge nozzle 300 is stored in the storage part 110, water may be discharged to the outside by pushing the water discharge lever 220 in a state in which the discharge flow path 311 of the removable discharge nozzle 300 is opened. If the removable discharge nozzle 300 is removed from the storage part 110, the water may be discharged to the outside by pushing the discharge button 340 of the removable discharge nozzle 300 in a state in which the water supply flow path is opened.

The ice supply flow path (not shown) is a flow path for delivering the ice pieces supplied from the ice maker of the refrigerator to the ice discharge unit 500. The ice supply flow path may be in communication with the ice discharge unit 500, more specifically an ice discharge port 510 of the ice discharge unit 500.

The ice discharge unit 500 may include an ice discharge port 510 disposed in the dispenser body 100 to communicate with the ice supply flow path, an ice guide 520 installed at the end of the ice discharge port 510, and an ice discharge lever 530 for selectively discharging the ice pieces from the ice discharge port 510.

In this regard, the ice guide 520 may extend from the end of the ice discharge port 510 by a predetermined length and may guide the ice pieces discharged from the ice discharge port 510 toward the lower side of the recess.

The ice discharge lever 530 is a push switch for ice discharge. The ice discharge lever 530 may be mounted on an inner wall of the recess of the dispenser body 100. At the rear side of the ice discharge lever 530, there may be disposed a switch (not shown) configured to generate a push sensing signal for opening the ice discharge port 510 when the push of the ice discharge lever 530 is sensed. Also disposed at the rear side of the ice discharge lever 530 is a spring structure (not shown) configured to automatically return the ice discharge lever 530 to an original position when the ice discharge lever 530 is released.

Figure 7:
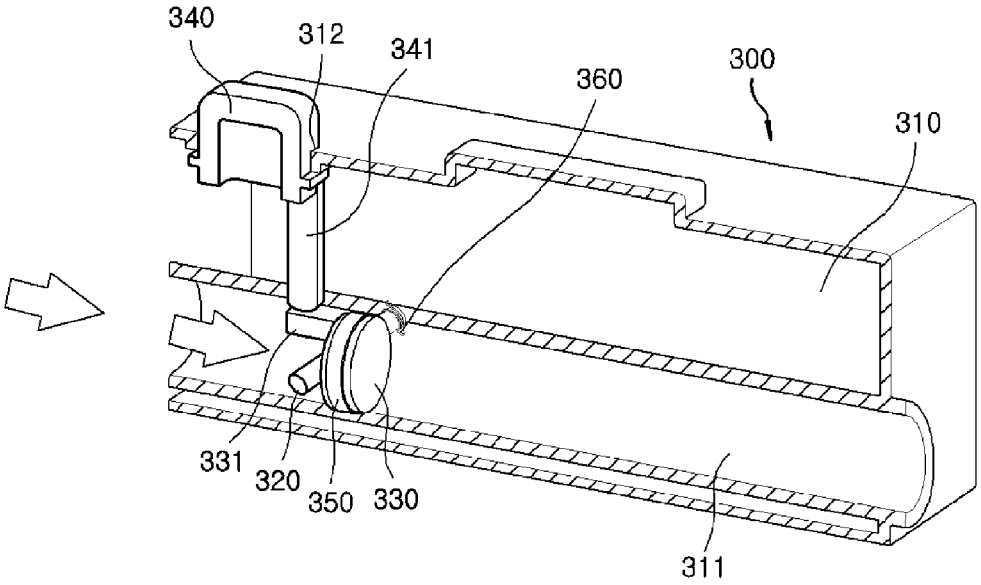
FIG. 7 is a partially cutaway perspective view taken along line VII-VII in FIG. 3.
Figure 8:
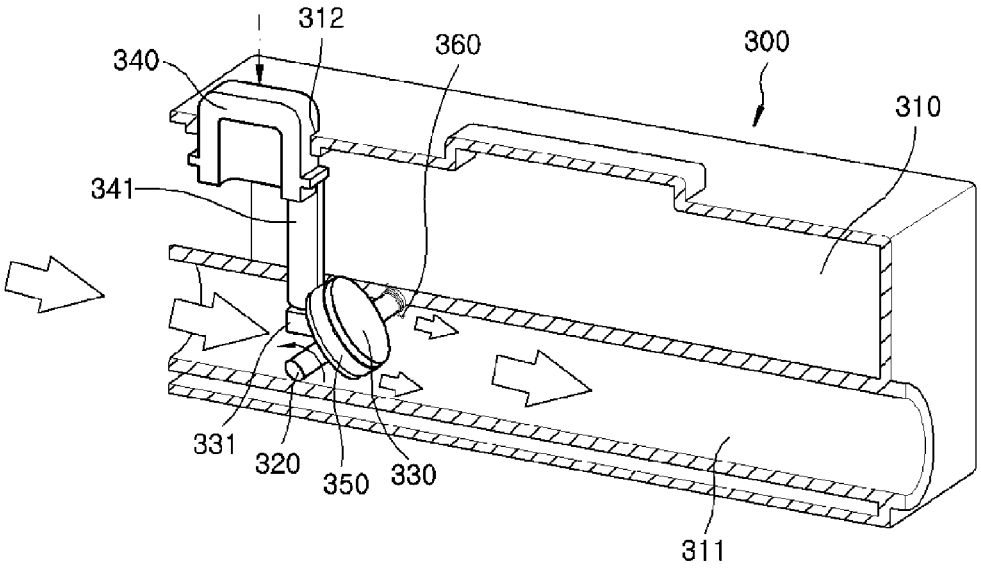
FIG. 8 is a view illustrating a state in which water is discharged through the removable discharge nozzle in the dispenser assembly according to one embodiment of the present disclosure.

FIG. 7 is a partially cutaway perspective view taken along line VII-VII in FIG. 3. FIG. 8 is a view illustrating a state in which water is discharged through the removable discharge nozzle in the dispenser assembly according to one embodiment of the present disclosure.

As illustrated in FIGS. 7 and 8, the removable discharge nozzle 300 may be removably installed in the storage part 110 of the dispenser body 100 and may selectively discharge the water supplied from the water supply flow path via the extension hose 400.

The removable discharge nozzle 300 may include a discharge body 310, a rotary shaft 320, an opening/closing member 330, a discharge button 340, an elastic member 360, an opening/closing bar 331 and a sealing member 350.

The discharge body 310 may have a housing shape conformal to the shape of the storage part 110 so that the discharge body 310 can be removably mounted to the storage part 110 of the dispenser body 100. The discharge flow path 311, through which water of the water supply flow path flows, is formed within the discharge body 310. A mounting slot 312, to which the discharge button 340 is movably fitted, may be formed in one wall of the discharge body 310.

The rotary shaft 320 is a shaft rotatably installed in the discharge flow path 311. The opening/closing member 330 may be mounted to the rotary shaft 320. For example, the opposite end portions of the rotary shaft 320 may be rotatably installed on the inner wall of the discharge flow path 311. The opening/closing member 330 may be fixed to the central portion of the rotary shaft 320.

The opening/closing member 330 is formed in a circular disk shape to selectively open and close the discharge flow path 311 in response to rotation of the rotary shaft 320. The opening/closing member 330 has an outer diameter substantially equal to an inner diameter of the discharge flow path 311.

On one side surface of the opening/closing member 330, there may be disposed an opening/closing bar 331 that can be pushed by a button bar 341 of the discharge button 340. The opening/closing bar 331 may perpendicularly extend from one side surface of the opening/closing member 330 so that the opening/closing bar 331 is positioned on a movement route of the button bar 341 of the discharge button 340.

Furthermore, a ring-shaped sealing member 350 may be disposed on an outer circumferential surface of the opening/closing member 330. When the discharge flow path 311 is closed by the opening/closing member 330, the sealing member 350 may seal a gap between the outer circumferential surface of the opening/closing member 330 and the inner circumferential surface of the discharge flow path 311, thereby preventing water leakage which may otherwise occur in the gap between the outer circumferential surface of the opening/closing member 330 and the inner circumferential surface of the discharge flow path 311.

The discharge button 340 is configured to push the opening/closing bar 331 to rotate the opening/closing member 330. The discharge button 340 may be movably installed on one sidewall of the discharge body 310. A button bar 341 may extend from an end portion of the discharge button 340 and can push the opening/closing bar 331 of the opening/closing member 330 when the discharge button 340 is pushed.

The elastic member 360 may be a torsion spring configured to return the rotary shaft 320 to an original phase. The elastic member 360 may apply an elastic force to the rotary shaft 320 to keep the opening/closing member 330 in a closed state with respect to the discharge flow path 311.

In the present embodiment, once the discharge button 340 is released, the rotary shaft 320 returns to the original position and the opening/closing member 330 closes the discharge flow path 311. However, the present disclosure is not limited thereto. To close the discharge flow path 311, different types of opening/closing systems may be applied to the removable discharge nozzle 300. For example, the discharge flow path 311 may be opened and closed using only the elastic force of the elastic member 360 without using a separate rotary shaft.

The extension hose 400 may be a tube for interconnecting the water supply flow path and the removable discharge nozzle 300. The extension hose 400 may be made of a flexible material which can be extended and contracted in a longitudinal direction. The extension hose 400 may be kept in a wound state by the roller 121 of the rolling accommodation part 120.

Accordingly, if the removable discharge nozzle 300 is pulled and removed from the storage part 110, the extension hose 400 may be drawn out of the rolling accommodation part 120 by a predetermined length. If the pulling force on the removable discharge nozzle 300 is released, the extension hose 400 may be retracted into the rolling accommodation part 120 by the winding action of the roller 121 and may be wound around the roller 121.

An operation of the dispenser assembly for a refrigerator configured as above is described as follows.

When a user tries to receive water by inserting a container into the recess of the dispenser body 100, it may be difficult to insert the container into the recess if the size of the container is larger than the vertical or transverse size of the recess.

In this case, if the removable discharge nozzle 300 is removed from the storage part 110 of the dispenser body 100 and pulled outward from the dispenser body 100, the extension hose 400 is drawn out from the rolling accommodation part 120. Thus, the removable discharge nozzle 300 may be moved to a position convenient to the user.

At this time, the sensing unit 610 may detect that the removable discharge nozzle 300 has been removed from the storage part 110 and may apply a corresponding sensing signal to the control unit 620. In response to the signal received from the sensing unit 610, the control unit 620 may apply a turning-on (pushing) operation signal to the water discharge lever 220, thereby keeping the water supply flow path in an open state.

Subsequently, if the discharge button 340 of the removable discharge nozzle 300 is pushed, the button bar 341 of the discharge button 340 pushes the opening/closing bar 331 of the opening/closing member 330. The opening/closing member 330 pushed by the opening/closing bar 331 is rotated together with the rotary shaft 320 (for example, counterclockwise in FIG. 8), thereby opening the discharge flow path 311. Water supplied from the water supply flow path may flow through the extension hose 400 and may be discharged to the outside through the discharge flow path 311 of the removable discharge nozzle 300.

If the discharge button 340 is released, the elastic member 360 returns the rotary shaft 320 to the original phase. At this time, the opening/closing member 330 may close the discharge flow path 311 as the rotary shaft 320 is rotated (for example, clockwise in FIG. 7). The discharge button 340 may be returned to an original position.

Thereafter, if the pulling force on the removable discharge nozzle 300 is released, the extension hose 400 may be retracted into the rolling accommodation part 120 by the winding action of the roller 121 and may be wound around the roller 121.

In this way, a user may discharge water to the outside by removing the removable discharge nozzle 300 from the storage part 110, pulling out the extension hose 400 by a desired length and pushing the discharge button 340 of the removable discharge nozzle 300. The user can advantageously dispense water to any container or object regardless of the size of the container or object.

When a user wishes to receive water by inserting a container into the recess of the dispenser body 100, the user can dispense water through the discharge flow path 311 of the removable discharge nozzle 300 by pushing the water discharge lever 220, because the discharge flow path 311 of the removable discharge nozzle 300 is kept in an open state when the removable discharge nozzle 300 is stored in the storage part 110.

If a user wishes to receive ice by inserting a container into the recess of the dispenser body 100, the user may push the ice discharge lever 530 when the container is inserted into the recess. As the ice discharge lever 530 is pushed, the ice discharge port 510 is opened. Thus, the user may dispense ice through the ice discharge port 510.

As described above, the present disclosure has an advantage in that it is possible to freely supply water from the dispenser through the removable discharge nozzle removably mounted to the dispenser, without restrictions in the vertical and transverse size with respect to the recess of the dispenser. Furthermore, the present disclosure has an advantage in that it is possible to supply water through the single removable discharge nozzle to a container positioned within the recess of the dispenser or a user (container) positioned distant from the dispenser body. In addition, the present disclosure has an advantage in that it is possible to easily supply water from the dispenser to a user through the use of the mechanical switching function of the removable discharge nozzle.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A dispenser assembly for a refrigerator, the dispenser assembly comprising:

a dispenser body defining an outer body of the dispenser assembly, wherein the dispenser body comprises a storage part;

a removable discharge nozzle configured to be placed in the storage part and configured to selectively discharge water supplied from a water supply flow path responsive to user interactions;

an extension hose configured to interconnect the water supply flow path and the removable discharge nozzle and to allow the removable discharge nozzle to be removed from the storage part to a location out of the dispenser body;

a water discharge lever configured to selectively open and close the water supply flow path responsive to user interactions;

a sensing unit configured to sense if the removable discharge nozzle is removed from the storage part; and a control unit coupled to the sensing unit and configured to supply a control signal for opening the water supply flow path to the water discharge lever when the sensing unit senses that the removable discharge nozzle is removed from the storage part.

2. The dispenser assembly of claim 1, wherein the removable discharge nozzle comprises:

a discharge body comprising a discharge flow path for water;

a rotary shaft disposed in the discharge flow path;

an opening/closing member fixed to the rotary shaft and operable to selectively open the discharge flow path; and a discharge button configured to interact with the opening/closing member to open the discharge flow path.

3. The dispenser assembly of claim 2, wherein the removable discharge nozzle further comprises:

an elastic member configured to maintain the opening/closing member in a closed state with respect to the discharge flow path;

an opening/closing bar protruding from the opening/closing member, wherein the discharge flow path is opened when the opening/closing bar is pushed by the discharge button; and a sealing member disposed on an outer circumferential surface of the opening/closing member.

4. The dispenser assembly of claim 1, wherein the storage part comprises an engagement portion configured to push the discharge button to open the discharge flow path when the removable discharge nozzle is placed in the storage part.

5. A refrigerator comprising:

a door; and a dispenser assembly coupled to the door, wherein the dispenser assembly comprises:

a dispenser body defining an outer body of the dispenser assembly, wherein the dispensing body comprises a storage part;

a removable discharge nozzle removably supported by the storage part and configured to selectively discharge water supplied from a water supply flow path responsive to user interactions;

an extension hose configured to interconnect the water supply flow path and the removable discharge nozzle and to allow the removable discharge nozzle to be pulled out from the storage part;

a water discharge lever configured to selectively open and close the water supply flow path responsive to user interactions;

a sensing unit configured to sense if the removable discharge nozzle is removed from the storage part; and a control unit coupled to the sensing unit and configured to supply a control signal for opening the water supply flow path to the water discharge lever when the sensing unit senses that the removable discharge nozzle is removed from the storage part.

6. The refrigerator of claim 5, wherein the removable discharge nozzle comprises:

a discharge body comprising a discharge flow path for water;

a rotary shaft installed in the discharge flow path;

an opening/closing member fixed to the rotary shaft and operable to selectively open the discharge flow path; and a discharge button configured to rotate the opening/closing member to open the discharge flow path.

7. The refrigerator of claim 6, wherein the removable discharge nozzle further comprises:

an elastic member configured to maintain the opening/closing member in a closed state with respect to the discharge flow path;

an opening/closing bar protruding from the opening/closing member, wherein the discharge flow path is opened when the opening/closing bar is pushed by the discharge button; and a sealing member disposed on an outer circumferential surface of the opening/closing member.

8. The refrigerator of claim 6, wherein the storage part comprises an engagement portion configured to push the discharge button to open the discharge flow path when the removable discharge nozzle is placed in the storage part.

* * * * *